US006547527B2

(12) United States Patent
Gaither

(10) Patent No.: US 6,547,527 B2
(45) Date of Patent: Apr. 15, 2003

(54) GENERATOR UNIT WITH CLUTCH-DRIVEN PUMP

(75) Inventor: Harold E. Gaither, Cordova, TN (US)

(73) Assignee: Fugitt Rubber & Supply Co., Ltd., Memphis, TN (US)

( * ) Notice: Subject to any disclaimer, the term of this patent is extended or adjusted under 35 U.S.C. 154(b) by 0 days.

(21) Appl. No.: 09/799,207

(22) Filed: Mar. 5, 2001

(65) Prior Publication Data

US 2002/0122727 A1 Sep. 5, 2002

(51) Int. Cl.[7] ..... F04B 49/00

(52) U.S. Cl. ..... 417/16; 417/212; 417/223; 417/364; 417/362; 417/199.1

(58) Field of Search ..... 417/212, 223, 417/364, 362, 199.1, 201

(56) References Cited

U.S. PATENT DOCUMENTS

| | | | | |
|---|---|---|---|---|
| 3,497,133 A | | 2/1970 | Childress et al. | 230/15 |
| 3,514,219 A | | 5/1970 | Mitchell et al. | 417/53 |
| 3,844,130 A | * | 10/1974 | Wahnish | 62/133 |
| 4,173,951 A | | 11/1979 | Ishihara | 123/2 |
| 4,264,282 A | * | 4/1981 | Crago | 181/202 |
| 4,293,281 A | | 10/1981 | Lamoreaux | 417/9 |
| 4,309,149 A | * | 1/1982 | McCombs, Jr. | 200/83 A |
| 4,393,964 A | | 7/1983 | Kemper | 192/0.044 |
| 4,520,688 A | | 6/1985 | Ban | 74/572 |
| 4,681,515 A | * | 7/1987 | Allen | 417/218 |
| 4,971,522 A | | 11/1990 | Butlin | 417/18 |
| 5,087,824 A | * | 2/1992 | Nelson | 290/1 A |
| 5,341,644 A | | 8/1994 | Nelson | 60/627 |
| 6,051,809 A | | 4/2000 | Colella | 219/133 |
| 6,099,265 A | | 8/2000 | Rowe, Jr. et al. | 417/313 |

OTHER PUBLICATIONS

Lincoln Electric Co., *Shield–Arc® SAE–400 WELD'N AIRir* (4 pages) (Dec. 1997).
Miller Electric Mfg. Co., *Miller Air Pak—Engine Driven Welding Generator* (6 pages) (Nov. 1998).
Megajet Workstations, *Megajet 4 in 1 Workstation* (3 pages)(2000).
Goodyear Tire and Rubber, *Eagle PD™ Engineering Manual* (1999).
Goodyear Tire and Rubber, *Driven Sprocket, W–34S–SH* (1999).
Goodyear Tire and Rubber, *Driver Sprocket, W–40S–BTS* (1999).
Goodyear Tire and Rubber, *Drive Belt, W–1280* (1999).

* cited by examiner

*Primary Examiner*—Cheryl J. Tyler
*Assistant Examiner*—Emmanuel Sayoc
(74) *Attorney, Agent, or Firm*—Butler, Snow, O'Mara, Stevens & Cannada PLLC

(57) ABSTRACT

A portable power unit having an internal combustion engine, a tank for holding a supply of pressurized fluid, an electrical generator powered by the internal combustion engine, and a pump selectively powered by the internal combustion engine. An electro-magnetic clutch is energized by a pressure switch on the tank when the pressure in the tank falls below a predetermined value, and a cooling fan for the pump may also be energized by the pressure switch together with the clutch. A non-slip positive drive belt couples power from the engine to the generator. The generator is overdriven at a shaft rotation speed above that of the engine's shaft, and the pump is underdriven at a shaft rotation speed below that of the engine's shaft.

7 Claims, 3 Drawing Sheets

GENERATOR UNIT WITH CLUTCH-DRIVEN PUMP

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to portable power generation and supply of a pressurized fluid, and in particular, to the portable combination of an electrical generator and a pump, with a single engine powering both the generator and the pump.

2. Information Disclosure Statement

Utilities, municipalities, contractors, plant maintenance personnel, and field service workers often require an electrical power source that is compact and reliable. Portable electrical power generators are well-known and are frequently used for such purposes.

Additionally, users of such portable electrical power generators also often require a source of pressurized fluid, such as, for example, a source of compressed air, pressurized hydraulic fluid, and/or pressurized water for spraying or high-pressure blasting. Prior art solutions for such problems have provided stand-alone electrical power generators that serve not only as a general-purpose source of electricity, but also as a source of electricity to power a compressor or pump so that the pressurized fluid can be provided. Other solutions provide a stand-alone electrical power generator and also a stand-alone compressor or pump powered, for example, by a gasoline engine. Still other prior art solutions provide an electrical power generator and compressor on a common power shaft with a driving motor, and such a solution is inefficient and wasteful of power because the pump is constantly driven, even when no additional pressure is required. These prior art solutions are inefficient, costly, and bulky for the user to transport to the site of use.

It is therefore desirable to have a compact, modular and integrated generator unit with pump unit, both driven from a single portable power source. It is further desirable to have a storage tank for holding the fluid that is pressurized by the pump unit, and the pump unit should only operate when the pressure in the storage tank is below a predetermined desired pressure. It is still further desirable to provide a cooling fan for cooling the pump unit, with the cooling fan only being engaged when the pump unit is in operation.

A preliminary patentability search in Class 290, subclasses 1A and 1R, and in Class 417, subclass 364, produced the following patents, some of which may be relevant to the present invention: Childress et al., U.S. Pat. No. 3,497,133 (issued Feb. 24, 1970); Mitchell et al., U.S. Pat. No. 3,514,219 (issued May 26, 1970); Ishihara, U.S. Pat. No. 4,173,951 (issued Nov. 13, 1979); Lamoreaux, U.S. Pat. No. 4,293,281 (issued Oct. 6, 1981); Nelson, U.S. Pat. No. 5,087,824 (issued Feb. 11, 1992); Nelson, U.S. Pat. No. 5,341,644 (issued Aug. 30, 1994); and Rowe, Jr. et al., U.S. Pat. No. 6,099,265 (issued Aug. 8, 2000).

Additionally, the inventor is aware of the following references, some of which may be relevant to the present invention: Colella, U.S. Pat. No. 6,051,809 (issued Apr. 18, 2000); Kemper, U.S. Pat. No. 4,393,964 (issued Jul. 19, 1983); Ban, U.S. Pat. No. 4,520,688 (issued Jun. 4, 1985); Butlin, U.S. Pat. No. 4,971,522 (issued Nov. 20, 1990); Lincoln Electric Co., Shield-Arc® SAE-400 WELD'N AIR (December 1997); Miller Electric Mfg. Co., *Miller Air Pak—Engine Driven Welding Generator* (November 1998); Megajet Workstations, *Megajet* 4 *in* 1 *Workstation* (2000); and data sheets and documentation from Goodyear Tire and Rubber Company describing the Driven Sprocket (W-34S-SH), Driver Sprocket (W-40S-BTS) and "Positive Drive" Belt (W-1280) that are used in implementing the preferred embodiment of the present invention.

None of these references, either singly or in combination, disclose or suggest the present invention.

BRIEF SUMMARY OF THE INVENTION

The present invention is a portable power unit with an internal combustion engine, having a constantly-powered electrical generator and an intermittently-powered pump means that is energized as required to maintain a source of pressure in a tank. An electromagnetic clutch is energized by a pressure switch on the tank, and a cooling fan for the pump may also be energized by the pressure switch on the tank.

It is an object of the present invention to provide compact, modular and integrated generator unit with pump unit, both driven from a single portable power source such as an internal combustion engine. It is further desirable to have a storage tank for holding the fluid that is pressurized by the pump unit, and the pump unit should only operate when the pressure in the storage tank is below a predetermined desired pressure.

DETAILED DESCRIPTION OF THE INVENTION

Figure 1:
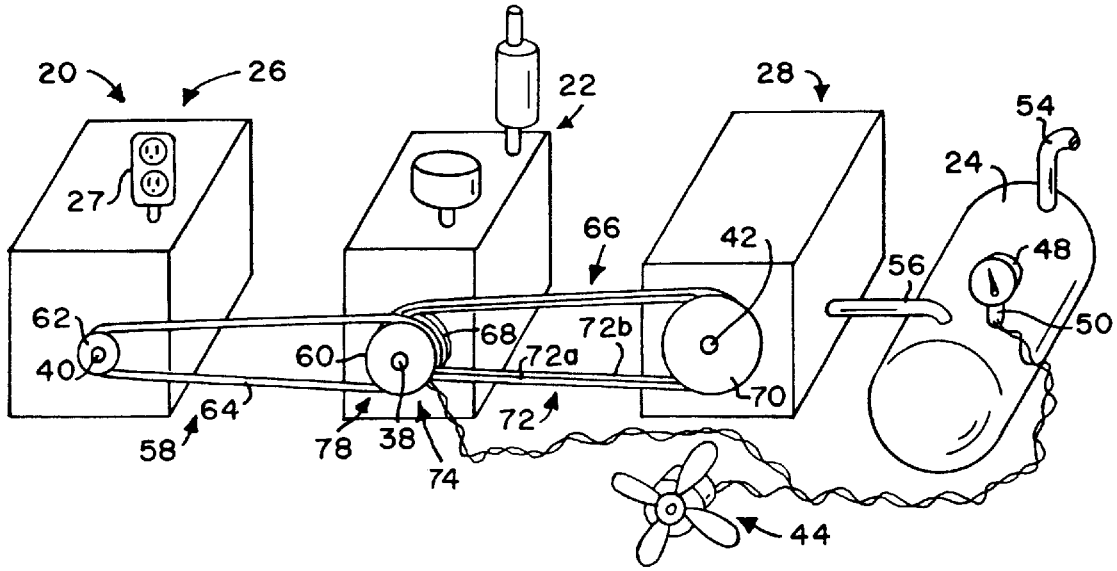
FIG. 1 is a schematic representation of the invention, showing the various parts thereof and their interconnection.

Referring to FIGS. 1–7 and 9–15, portable power unit 20 is seen to include an internal combustion engine 22, a tank 24 for holding a supply of pressurized fluid therein, electrical generator means 26 for generating electricity, and pump means 28, in communication with the interior of tank 24, for pressurizing the fluid into the interior of tank 24. It should be understood that many of the representative components of power unit 20 shown in FIG. 1, e.g., engine 22, tank 24, generator means 26, and pump means 28, are well-known to those skilled in the art, so these well-known components are shown without their well-known parts being discussed in great detail.

Figure 3:
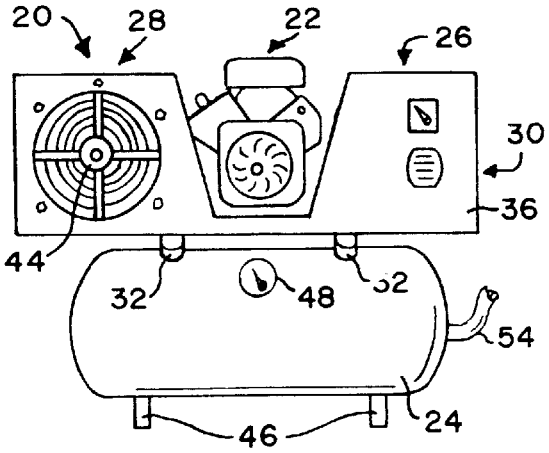
FIG. 3 is a front view of the invention showing the mounting of the various parts.
Figure 4:
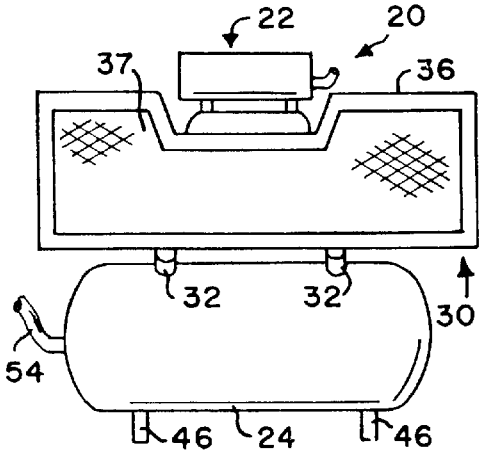
FIG. 4 is a rear view of the invention showing the mounting of the various parts.
Figure 5:
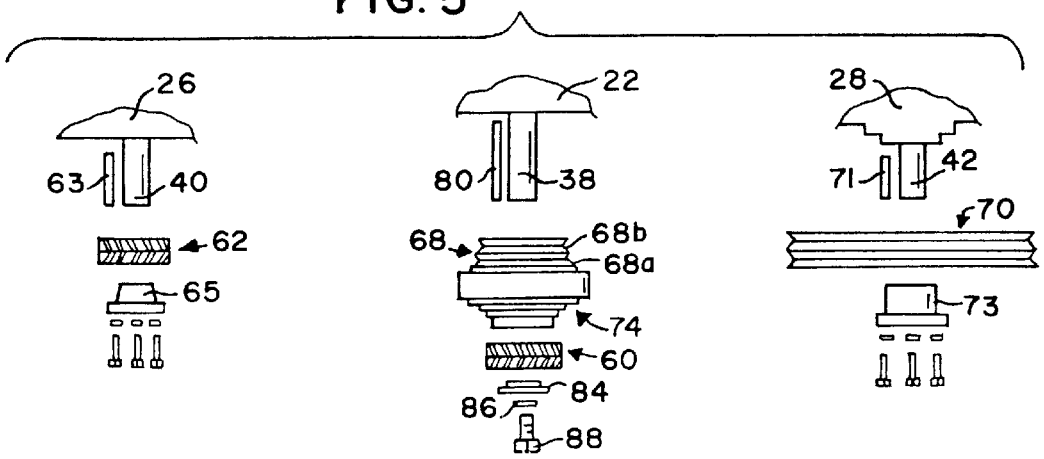
FIG. 5 is a partial exploded top plan view showing some of the parts of the primary and secondary drive means and the electromagnetic clutch means.
Figure 6:
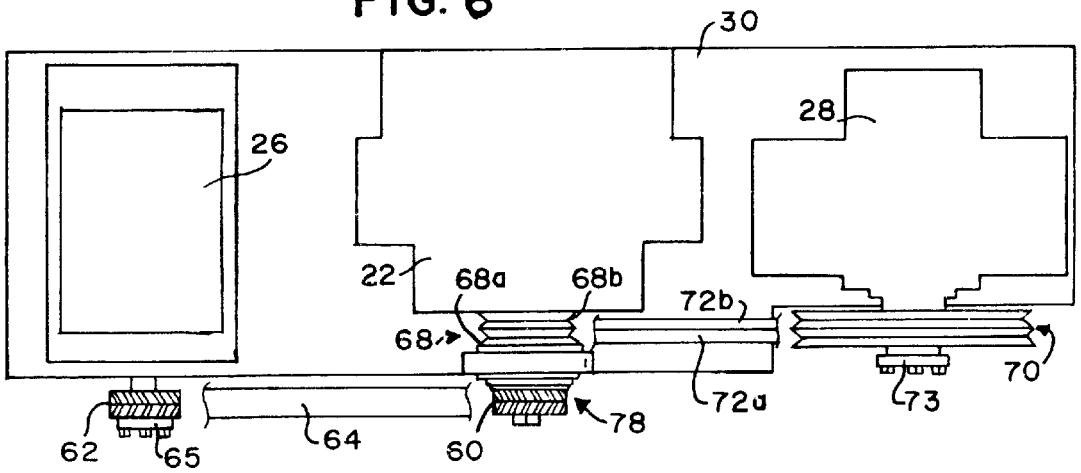
FIG. 6 is a top plan view of the invention with the cover removed and showing some of the parts of the primary and secondary drive means and the electromagnetic clutch means, with portions of the drive belts removed to show hidden detail.
Figure 7:
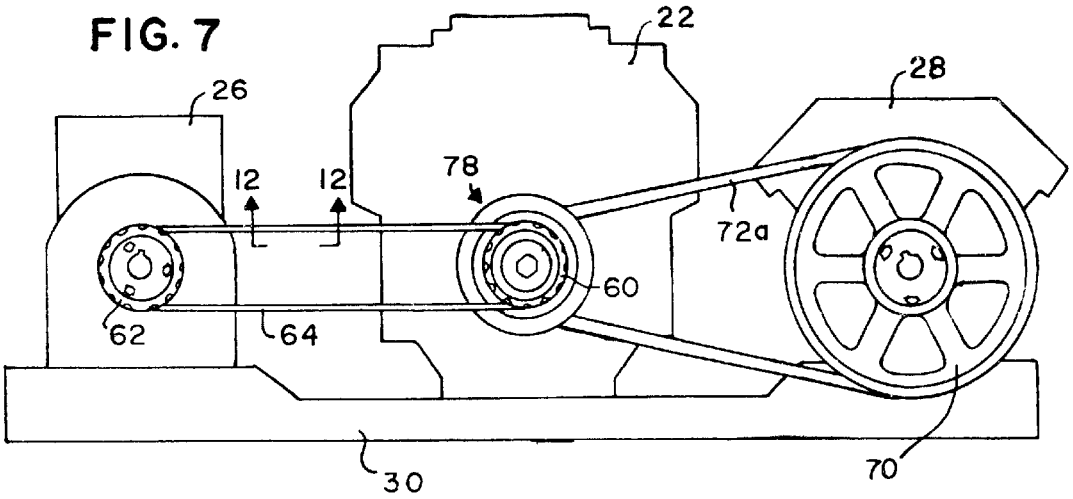
FIG. 7 is a partial front elevation of the invention with the enclosure removed.

As seen best in FIGS. 3 and 4, the components of portable power unit 20 are preferably mounted upon an integrated chassis 30 of a semi-enclosed modular design, allowing for portability and ease of servicing. Chassis 30 is preferably of a compact rectangular configuration as shown, durably constructed to withstand the weight bearing load, stress and vibration of the operating components of power unit 20. Chassis 30 is constructed without baffles or partitions and is preferably mounted atop tank 24 by a plurality of well-known vibration-isolating mounts 32. Chassis 30 provides for primary and auxiliary grounding points for engine 22 and electrical generator means 26, and is designed to accommodate wellknown bulkhead-type connectors for flexible hose and wiring components. Chassis 30 provides a space for a well-known 12 volt DC battery 34 used in starting engine 22, provides attachment points for mounting an enclosure 36 and its integral belt guard 37 for protection of workers, and further provides for the attachment of service points, control devices, harness wiring, and accessories in a manner well-known to those skilled in the art. Chassis 30 and enclosure 36 are preferably constructed of a material such as steel so as to maintain design integrity, may be unpainted, powder coated, plated or preferably painted, and allow for the free circulation of cooling air.

Preferably, engine 22 is mounted in the center of chassis 30 with electrical generator means 26 being mounted to one side of engine 22 and with pump means 28 being mounted to the other side of engine 22, with the drive shaft 38 of engine 22 preferably being in a more or less even horizontal plane with first driven shaft 40 of electrical generator means 26 and with second driven shaft 42 of pump means 28, and preferably with the center-to-center shaft distance between drive shaft 38 and first driven shave 40 being approximately equal to the center-to-center shaft distance between drive shaft 38 and second driven shaft 42. Chassis 30 preferably may also provide an auxiliary battery boost and charging connector and a remote oil filter for engine 22, and may further provide various well-known warning indicators such as indicator lights to indicate when the oil within pump means 28 is low and/or when the oil pressure within engine 22 is low. Enclosure 36 further provides for the mounting of a 12 volt auxiliary electric cooling fan 44 for pump means 28, as hereinafter further described. The various components of power unit 20 are preferably mounted upon chassis 30 so that all component cooling air is taken in from one side and all of the heated exhaust air is discharged from the other, with the engine exhaust being likewise discharged in the heated exhaust air stream. Power unit 20 may either be mounted on skids or upon a truck or trailer, as required.

Internal combustion engine 22 is well-known to those skilled in the art, and may be of a single, twin, or multiple cylinder design, powered by any of a number of well-known fuels such as gasoline, diesel fuel, or liquid propane gas, and may either be water or air cooled. Engine 22 should have variable or fixed speed governing means of either an electronic or mechanical design. Preferably, engine 22 is a twin-cylinder, gasoline powered, air-cooled engine of no less than a 20-horsepower rating with electric starting and a remote fuel tank, and has a variable speed mechanical governor adapted for fixed speed use above 3,000 RPM. A suitable engine for use with the present invention is the Model CH22 engine sold by the Kohler Company, Engine Division, in Kohler, Wis. 53044. It shall be understood that engine 22 provides the power for unit 20 because, as hereinafter explained in detail, electrical generator means 26 and pump means 28 are operably coupled to and powered from the power take-off ("PTO") drive shaft 38 of engine 22.

Electrical generator means 26 is well-known to those skilled in the art and is preferably a horizontal shaft, 2-bearing configuration of brush or brushless design, preferably either a 2-pole, 120/240 volt AC, 60 cycle, single or three-phase generator operating at 3,600 RPM, or a 4-pole, 120/240/480 volt AC, 60 cycle, single or three-phase generator operating at 1,800 RPM. The preferred generator means 26 is a brushless design providing 2-pole, single-phase 60 cycle power at 120/240 volt AC, operating at 3,600 RPM with a rating of no less than 7 kW. A suitable generator for use with the present invention is the Model BDN75 generator sold by the Gillette Manufacturing Company, 1340 Wade Drive, Elkhart, Ind. 46514. Other well-known electrical generators of greater or lesser capacity may be selected, as required, in a manner well-known to those skilled in the art. It shall be understood that electrical generator means 26 is powered by rotation of its first driven shaft 40 in a manner well-known to those skilled in the art, and that electrical power is provided, for example, at well-known electrical outlets 27.

Well-known tank 24 provides a pressurized reservoir for holding a pressurized fluid, such as pressurized air, pressurized hydraulic fluid, or pressurized water for spraying or blasting. Tank 24 is constructed in accordance with ASME code specifications, and is preferably fitted with a four-point platform-type foot design 46, and preferably has a well-known multiple air disconnect manifold with shut-off valve, an air pressure safety relief valve, a one-way check valve interposed between pump means 28 and tank 24, and may also preferably include well-known inspection ports and a drain. Tank 24 further includes a wellknown pressure gauge 48 with well-known pressure switch means 50, responsive to the pressure of the pressurized fluid within the interior of tank 24, for actuating an electrical circuit 52, as hereinafter described, when the pressure of the pressurized fluid within the interior of tank 24 is below a certain predetermined value. A constant source of pressurized fluid is thus provided at the outlet of tank 24 as by, for example, through pressure hose 54.

Pump means 28 is a reciprocating or rotary-style design of single, twin, or multiple-cylinder configuration having a preferably horizontal second driven shaft 42, and pump means 28 is in communication with the interior of tank 24 as through pressure hose 54. Preferably, a well-known manifold (not shown), having a plurality of sleeve-type quick-disconnect fittings and mounted to tank 24, may be interposed between pressure hose 54 and tank 24, and a coupling may also be provided on the manifold to allow attachment of a well-known air regulator and/or filter/dryer. Furthermore, a well-known ball valve may preferably be interposed between the sleeve-type quick-disconnect fittings and tank 24 in a manner well-known to those skilled in the art. Depending on the requirements of the specific application chosen for power unit 20, pump means 28 may be, for example, a compressor for providing compressed air, a hydraulic fluid pump for providing pressurized hydraulic fluid, or a high-pressure water pump. The representative pump means 28 shown is a reciprocating piston multiple-cylinder design having a rating of at least 18 cubic feet per minute at 100 pounds per square inch. A suitable compressor for use as the pump means of the present invention is the Model V360 compressor sold by the P. K. Lindsey Company, 63 Nottingham Road, Deerfield, N.H. 03037. It shall be understood that pump means 28 is powered by rotation of second driven shaft 42.

Power is transferred from engine 22 to electrical generator means 26 by primary drive means 58, hereinafter described, operably coupling drive shaft 38 of engine 22 to first driven shaft 40 of electrical generator means 26. Primary drive means 58 includes a first drive pulley 60 fixedly attached to drive shaft 38 for simultaneous rotation therewith, a first driven pulley 62 fixedly attached to first driven shaft 40 of electrical generator means 26 for simultaneous rotation with first driven shaft 40, and first drive belt means 64 operably coupling first drive pulley 60 to first driven pulley 62 for mutual co-rotation therewith.

Figure 12:
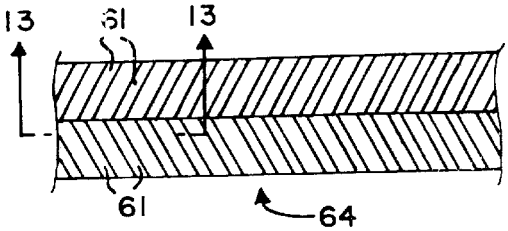
FIG. 12 is a view of a portion of the first drive belt means showing the tooth pattern thereon, taken substantially along the line 12—12 shown in FIG. 7.
Figure 13:
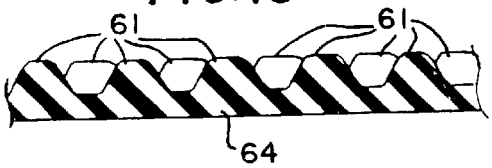
FIG. 13 is a partial longitudinal sectional view of the first drive belt means, taken substantially along the line 13—13 shown in FIG. 12.

So as to provide for no slippage between drive shaft 38 and first driven shaft 40, first drive belt means 64 is a so-called direct coupled "positive drive" (non-slip) toothed design having either straight teeth or preferably having helical offset teeth. First drive pulley 60 and first driven pulley 62 are of flanged or preferably non-flanged design matching and engagingly mating with the tooth configuration on belt means 64. Preferably, first drive pulley 60 is a modified version of a model W-40S-BTS driver sprocket made by the Goodyear Tire and Rubber Company, Akron, Ohio, modified in a manner hereinafter described and having 40 teeth and a diameter of 3.956 inches (10.05 cm.). Preferably, first driven pulley 62 is a model W-34S-SH driven sprocket having 34 teeth and a diameter of 3.355 inches (8.52 cm.), also made by the Goodyear Tire and Rubber Company. While drive shaft 38 may be coupled to first driven shaft 40 in an overdrive, underdrive, or 1:1 driven ratio, generator means 26 is preferably overdriven, with first drive pulley 60 preferably having a larger diameter, by a ratio of about 1:1.18, than the diameter of first driven pulley 62 so that the speed of first driven shaft 40 is about 1.18 times the speed of drive shaft 38. Belt means 64 is preferably engineered to twice the horsepower rating of engine 22, and preferably uses a positive drive belt of helical offset tooth design, preferably a Model W-1280 drive belt as manufactured by the Goodyear Tire and Rubber Company and sold under the trademark "Eagle PD". FIG. 12 shows a view of a portion of first drive belt means 64, showing the helical offset tooth pattern thereon, taken substantially along the line 12—12 shown in FIG. 7. FIG. 13 is a partial longitudinal sectional view of first drive belt means 64, taken substantially along the line 13—13 shown in FIG. 12. In the preferred embodiment of the present invention, belt means 64 has a belt width of 1.260 inches (3.20 cm.), a total thickness of 0.210 inches (0.533 cm.), a tooth height of 0.120 inches (0.305 cm.), and a tooth pattern of teeth 61 that matingly engages with first driven pulley 62 and first drive pulley 60. Such a positive drive belt provides for no slippage of the pulleys and thereby provides for improved voltage regulation and control of generator means 26. Furthermore, having first driven shaft 40 be separate from drive shaft 38, with coupling via belt means 64, allows the speed of drive shaft 38 to be different from the speed of first driven shaft 40, and belt means 64 also absorbs a substantial amount of torsional stress, vibration and torque impulses from the engine-generator combination, thereby creating a smoother operating unit with increased engine bearing and crankshaft longevity. Additionally, for a given driven pulley speed, the overdrive arrangement (with first drive pulley 60 being larger in diameter than first driven pulley 62) increases the fuel economy and longevity of engine 22 while lowering the noise levels of power unit 20 and the pollution output by engine 22. Additionally, engine 22 is thus allowed to run near the top end of its torque curve, thereby providing less R.P.M. deviation when transient load application is applied, by having more torque available in a narrower R.P.M. range. Additionally, the increased rotation speed of first driven shaft 40 of generator means 26 serves to multiply the rotational inertia seen by engine 22 through primary drive means 58, further decreasing rotational speed variations as compared to a generator of similar size and mass rotating at the same speed as engine 22. This increased kinetic energy provided by the more rapidly rotating first driven shaft 40 of generator means 26 acts to reduce the precision with which the engine speed must be maintained as the load on engine 22 varies.

First driven pulley 62 is fixedly secured to first driven shaft 40 of generator means 26 by a well-known shaft key 63 that engages mating slots in pulley 62 and in shaft 40 and the mounted pulley is held in place by a well-known shaft bushing adapter 65.

Power is transferred from engine 22 to pump means 28 by secondary drive means 66, hereinafter described, selectively operably coupling drive shaft 38 of engine 22 to second driven shaft 42 of pump means 28. Secondary drive means 66 includes a second drive pulley 68 operably coupled to drive shaft 38, a second driven pulley 70 operably coupled to second driven shaft 42 of pump means 28, second drive belt means 72 operably coupling second drive pulley 68 to second driven pulley 70 for mutual co-rotation, and electromagnetic clutch means 74 for selectively causing drive shaft 38 to be coupled to second driven shaft 42 of pump means 28 for mutual co-rotation when electromagnetic clutch means 74 is energized. Preferably, clutch means 74 is mounted upon drive shaft 38 of engine 22 and second driven pulley 70 is fixedly secured to second driven shaft 42 of pump means 28 so that, when clutch means 74 is energized, clutch means 74 causes second drive pulley 68 to co-rotate with drive shaft 38, thereby causing second driven pulley 70 to rotate and thereby power pump means 28. A suitable clutch means 74 and combination second drive pulley 68 has been found to be the Type 3 General Purpose clutch, part number 509044, sold by Ogura Industrial Corporation, 400 Cottontail Lane, Somerset, N.J. 08873, with a rating of 250 foot-pounds (339 Newton-meters) of static torque and using about 50 watts of a 12 volt DC electrical signal to become energized. It will be understood, however, that the clutch means could alternatively and equivalently be mounted to second driven shaft 42 with second drive pulley 68 fixedly mounted to drive shaft 38 of engine 22, so that, when the clutch means is engaged, the rotation of second driven pulley 70 would cause second driven shaft 42 to rotate, thereby powering pump means 28.

Second drive belt means 72 may be of the V-belt or flat grove belt design, with single, dual, or multiple belts, but preferably second drive belt means 72 is a dual V-belt design. While secondary drive means 66 may be either an overdrive, underdrive, or straight 1:1 drive ratio, preferably pump means 66 is underdriven at an approximate speed ratio of 2.6:1, with the diameter of second drive pulley 68 being smaller than the diameter of second driven pulley 70 by a like ratio of 2.6:1. Second drive belt means 72 and clutch means 74 are preferably engineered to twice the horsepower/torque rating of pump means 28. Second drive belt means 72 is preferably a well-known dual V-belt design having twin belts 72*a*, 72*b* and with second drive pulley having dual V-grooves 68*a*, 68*b* to accommodate the dual V-belt design and with second driven pulley 70 likewise having dual V-grooves.

Second driven pulley 70 is fixedly secured to second driven shaft 42 of pump means 28 by a well-known shaft key 71 that engages mating slots in pulley 70 and in shaft 42 and the mounted pulley is held in place by a well-known shaft bushing adapter 73.

Figure 2:
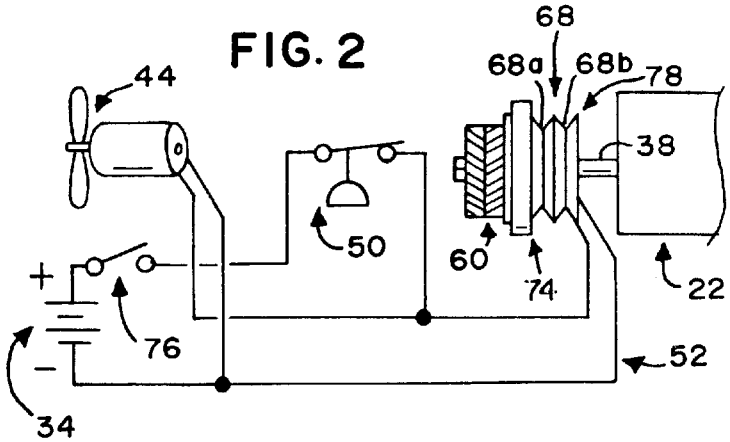
FIG. 2 is an electrical schematic of the invention showing the energizing of the fan and clutch by the pressure switch.

As shown in FIG. 2, electromagnetic clutch means 74 is connected through electrical circuit 52 to a source of electrical power such as battery 34 of engine 22, it being understood that engine 22 recharges battery 34 in a manner well-known to those skilled in the art. Interposed between electromagnetic clutch means 74 and the source of electrical power is pressure switch means 50 responsive to the pressure of the pressurized fluid within the interior of tank 24. When the pressure inside tank 24 drops below the pre-set actuation point for pressure switch means 50, the pressure switch means 50 closes the electrical circuit, thereby energizing clutch means 74 and causing mechanical power to be transmitted through secondary drive means 66 from engine 22 to pump means 28, thereby causing pump means 28 to supply pressurized fluid to tank 24. When the pressure within tank 24 rises above the pre-set actuation point for pressure switch means 50, the pressure switch means 50 opens the electrical circuit, thereby causing clutch means 74 to be de-energized, thereby ceasing to cause pump means 28 to provide further pressurized fluid to tank 24. An additional manually-operated switch 76 may be wired as shown in series with pressure switch means 50 so as to disable the operation of pump means 28, thereby allowing power unit 20 to only be used for generation of electricity by generator means 26. For example, pressure switch means 50 could have a trip or activation pressure setting of approximately 85 P.S.I., and will energize clutch means 74 if the sensed pressure within tank 24 is below this threshold, and pressure switch means will have a cutoff pressure of approximately 120 P.S.I., and will deenergize clutch means 74 if the sensed pressure within tank 24 is above this threshold. This differential of approximately 35 P.S.I. between the activation pressure and the cutoff pressure prevents clutch means 74 from rapidly cycling pump means 28 off and on. Preferably, and if desired, a well-known indicator light may be electrically connected in parallel with clutch means 74 so as to provide a visual indication that clutch means 74 is engaged.

Preferably an electric cooling fan 44 is provided for cooling pump means 28, and cooling fan 44 is preferably wired in parallel with electromagnetic clutch means 74 so that fan 44 operates to cool pump means 28 whenever pump means 28 is powered by the energizing of clutch means 74. Preferably, fuses may be provided to protect both electric cooling fan 44 and clutch means 74 from overload and/or burnout.

Figure 15:
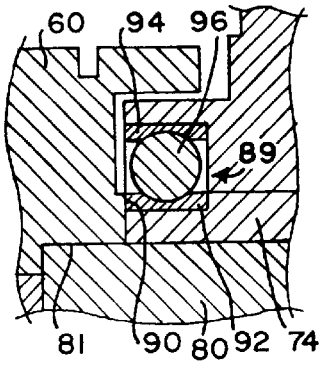
FIG. 15 is an enlarged sectional view of a portion of FIG. 14, showing details of the mounting of the bearing between the clutch means and the first drive pulley.
Figure 11:
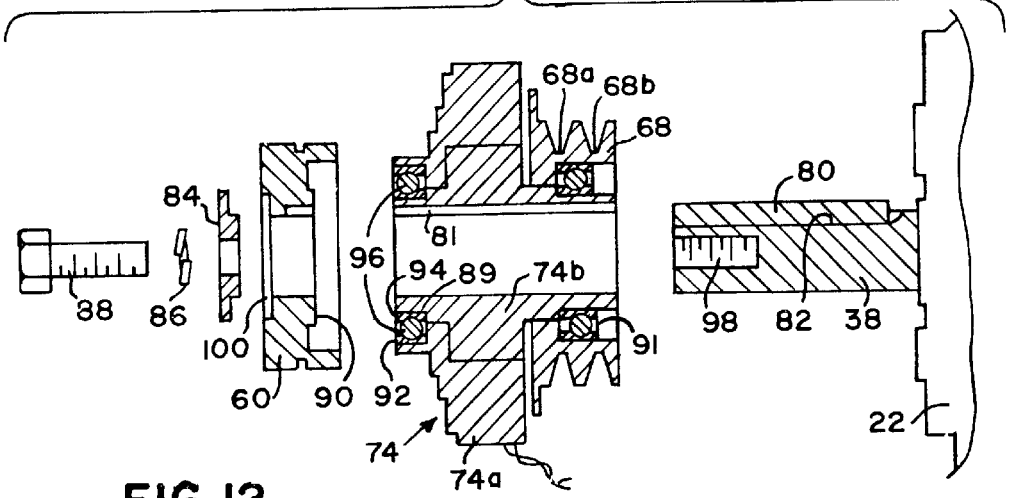
FIG. 11 is an exploded longitudinal sectional view of the drive shaft of the engine of the present invention, showing the mounting of the clutch means and pulleys thereon.
Figure 14:
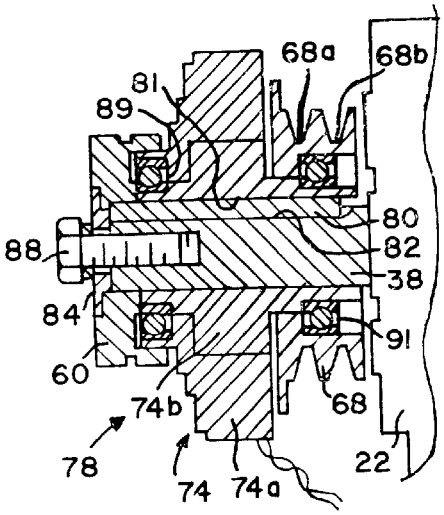
FIG. 14 is a longitudinal sectional view of the drive shaft of the engine of the present invention, showing the assembly and mounting of the parts shown in FIG. 11.

Preferably, and as best seen in FIGS. 11, 14, and 15, clutch means 74 and first and second drive pulleys 60, 68 are constructed as a unified assembly 78 mounted to drive shaft 38 of engine 22. There are six primary parts to this unified assembly 78, namely, a shaft key 80 for engagingly securing a slot 81 of the assembly to a slot 82 in drive shaft 38, a secondary drive clutch and pulley assembly including clutch means 74 and second drive pulley 68 (with its dual V-belt grooves 68*a*, 68*b*), a primary drive assembly including first drive pulley 60, a shaft bushing 84 for mating the primary drive assembly with the drive shaft 38, a lockwasher 86, and a bolt 88. It should be noted, as seen best in FIG. 15, that first drive pulley 60 must be fitted against the clutch means 74 so as not to interfere with the first clutch bearing race 89 and to allow for the clutch assembly to be received into and against the first drive pulley 60. It shall be understood that first clutch bearing race 89 allows the electromagnetic field coils 74*a* of clutch means 74 to remain stationary while drive shaft 38, keyed to the inner portion 74*b* of clutch means 74, causes inner portion 74*b* to co-rotate with drive shaft 38. Second drive pulley 68 is mounted to inner portion 74*b* of clutch means 74 upon a second clutch bearing race 91 that allows drive shaft 38 to freely rotate with respect to second drive pulley 68 when clutch means 74 is not engaged. To allow electromagnetic field coils 74*a* of clutch means 74 to remain stationary while drive shaft 38 rotates, it is important that the raised mating surface 90 of first drive pulley 60 firmly contacts the inner strap 92 of clutch bearing race 89 and that raised mating surface 90 of first drive pulley 60 not contact the outer strap 94 of clutch bearing race 89, thereby allowing bearings 96 within clutch bearing race 89 to permit drive shaft 38 to rotate with respect to stationary electromagnetic field coils 74*a*. Lockwasher 86 and bolt 88 secure the unified assembly to the drive shaft 38 with bolt 88 engaging internal threads 98 of the axially-threaded end of drive shaft 38 in a manner well-known to those skilled in the art.

Figure 8:
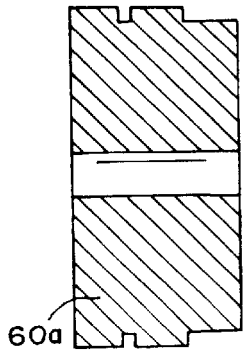
FIG. 8 (Prior Art)
FIG. 8 is a longitudinal sectional view of a prior art drive pulley, taken along a diameter thereof, before modification for use with the present invention.
Figure 9:
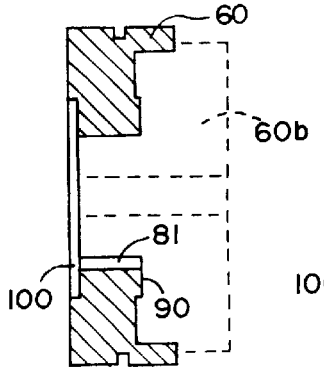
FIG. 9 is a longitudinal sectional view of the first drive pulley of the present invention, showing, in dotted outline, material that is removed from the prior art drive pulley of FIG. 8.
Figure 10:
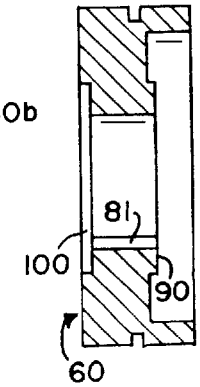
FIG. 10 is a longitudinal sectional view of the first drive pulley of the present invention, taken along a diameter thereof.

In order to provide for proper mating of first drive pulley 60 with clutch means 74, it has been found necessary to modify a standard prior art drive pulley 60*a*, as shown in FIG. 8, by machining the prior art drive pulley 60*a* to remove excess metal. FIG. 9 shows how a prior art drive pulley 60*a*, preferably a model W-40S-BTS driver sprocket made by the Goodyear Tire and Rubber Company, is modified by removing excess metal 60*b* shown in dotted outline in FIG. 9, enlarging the axial bore to fit the drive shaft 38 of engine 22, creating a slot 81 for shaft key 80, creating raised mating surface 90 to engagingly mate with inner strap 92 of clutch bearing race 89, and countersinking a bore 100 to receive shaft bushing 84, thereby creating a first drive pulley 60 that closely and compactly mounts upon drive shaft 38 of engine 22.

Because electrical generator means 26 is always powered by primary drive means 58, power unit 20 provides a continuous source of electrical power at, for example, electrical outlets 27.

When pressure switch means 50 causes clutch means 74 to be energized, as momentary but acceptable voltage fluctuation may be seen at the output of generator means 26 as the load on engine 22 abruptly changes. A mechanical governor on engine 22 is used to maintain the speed of engine 22 within a tolerance of 4%.

It is important to size engine 22 so as to provide for generation of electrical power while also providing sufficient power for pump means 28, and also to accommodate load variations caused by energizing of pump means 28 and fluctuations in the load seen by generator means 26. Preferably, engine 22 is sized so as to reserve approximately 70% of its power for powering of generator means 26 and so as to reserve the remaining 30% of its power for the powering of pump means 28. Additionally, as heretofore explained, a combination of overdriving of electrical generator means 26 is used together with underdriving of pump means 28 so as to allow engine 22 to operate at a slower speed while also being at an efficient point on its torque curve.

Both electronic and mechanical governors are well-known for controlling the speed of engines such as engine 22. Electronic governors, because of their sensitivity, tend to provide improved speed regulation during steady state load conditions but also tend to overshoot/undershoot their speed range settings as the transient power load on the engine abruptly changes, as happens when clutch means 74 of the present invention is energized and de-energized. Such overshoot/undershoot in speed is undesirable in the present invention because it would cause the electrical power generated by generator means 26 to have undesirable voltage spikes.

Mechanical speed controls or governors provide for inherent droop control (loss of engine speed as the load increases) and can also provide acceptable speed tolerances of 3% to 5%. A mechanical governor was chosen for the preferred embodiment, and was adjusted and tuned for an approximate 4% speed regulation during either an unloaded or loaded state, or during transient cycling of the pump means 28. Such a governor, adjusted for such a 4% regulation, was found to provide an acceptable regulation of the speed of engine 22 with acceptable droop slowdown of engine 22 during application of load. In order to achieve this preferred 4% speed regulation, the standard mechanical governor of the preferred Model CH22 Kohler engine was modified by substituting a stiffer governor tensioning spring to the governor pivot arm in place of the standard tensioning spring provided with the engine, and this stiffer governor tensioning spring was then attached to an attachment point somewhat closer to the pivot point on the governor pivot arm than was used by the standard tensioning spring, thereby applying a higher tensioning force at a lesser lever moment. Additionally, a vernier adjustment was added to the throttle linkage of the engine's throttle cable, in a manner well-known to those skilled in the art, so that more precise engine R.P.M. adjustments could be made to accommodate for wear and vibration during use.

Because the engine 22 of the present invention is operated well below its maximum speed and yet closer to its slower speed torque-producing curve, instantaneous power is available and the engine is also less susceptible to R.P.M. deviation during transient load power requirements.

The V-belt design for secondary drive means 66 allows for a small amount of slippage during energizing of clutch means 74, thereby providing a smoother transition to operating speed and reduction in the instantaneous load change when both the pump means 28 and generator means 26 become powered. The positive drive of primary drive means 58 ensures that such slippage does not occur for generator means 26.

By allowing pump means 28 to be decoupled from engine 22 when the clutch is de-energized, pump means 28 will have increased longevity and lower maintenance than heretofore seen in prior art designs, and engine 22 will have a reduced load when only driving generator means 26.

Additionally, because generator means 26 is overdriven by engine 22, the substantial rotational inertia of generator means 26 acts to provide a torque boos to engine 22 when the load on engine 22 increases when clutch 74 engages, thereby providing smaller engine R.P.M. deviation (and thus smaller output voltage deviation by generator means 26) than might otherwise be the case, and such improved transient load characteristics of the present invention are believed to be superior to that heretofore seen in the prior art, and the generator means 26 thus acts as an effective flywheel for engine 22 for smoothing out transient load effects when clutch 74 is energized and de-energized.

The configuration of engine 22 between generator means 26 and pump means 28 tends to equalize the belt tension forces applied to engine shaft 38, thereby increasing the engine life expectancy due to reduced crankshaft bearing load/stress for engine 22.

To use the power unit 20 of the present invention, the user sets the desired pressures to be sensed by pressure switch 50 so as to maintain a desired pressure within tank 24. Engine 22 is then started, and generator means 26 will begin providing power at outlets 27. Pressure switch 50 will cause clutch means 74 to energize and de-energize, as necessary, to cause pump means 28 to pressurize tank 24 to the desired pressure. If only electrical power is desired, pump means 28 can be disabled by opening manual switch 76.

Although the present invention has been described and illustrated with respect to a preferred embodiment and a preferred use therefor, it is not to be so limited since modifications and changes can be made therein which are within the full intended scope of the invention.

I claim:

1. A portable power unit, said power unit comprising:

(a) an internal combustion engine having a drive shaft;

(b) a tank having an interior for holding a supply of a pressurized fluid therein, said tank including pressure switch means, responsive to the pressure of the pressurized fluid within said interior of said tank, for actuating an electrical circuit when the pressure of the pressurized fluid within said interior of said tank is below a certain predetermined value;

(c) an electrical generator means for generating electricity, said electrical generator means having a first driven shaft, said electrical generator means being powered by rotation of said first driven shaft;

(d) a pump means, in communication with the interior of said tank, for pressurizing said fluid into said interior of said tank; said pump means having a second driven shaft, said pump means being powered by rotation of said second driven shaft;

(e) a primary drive means for operably coupling said drive shaft to said first driven shaft, said primary drive means comprising:

i. a first drive pulley fixedly attached to said drive shaft;

ii. a first driven pulley fixedly attached to said first driven shaft; and iii. first drive belt means operably coupling said first drive pulley to said first driven pulley for mutual co-rotation;

(f) a secondary drive means for selectively operably coupling said drive shaft to said second driven shaft, said secondary drive means comprising:

i. a second drive pulley operably coupled to said drive shaft;

ii. a second driven pulley operably coupled to said second driven shaft;

iii. second drive belt means operably coupling said second drive pulley to said second driven pulley for mutual co-rotation; and iv. electromagnetic clutch means for selectively causing said drive shaft to be coupled to said second driven shaft for mutual co-rotation when said electromagnetic clutch means is energized, said electromagnetic clutch means being operably interconnected with said pressure switch means so that the actuating of said electrical circuit causes said electromagnetic clutch means to be energized wherein said internal combustion engine is between said electrical generator means and pump means; and (g) an electric fan for cooling said pump means, said electric fan being actuated by said pressure switch means together with said electro-magnetic clutch means.

2. The portable power unit as recited in claim 1, in which said first drive belt means includes a toothed belt having a plurality of protruding teeth and said first drive pulley and said first driven pulley both have mating recesses engaged by said protruding teeth.

3. The portable power unit as recited in claim 1, in which said first drive pulley is larger in diameter than said first driven pulley and said second drive pulley is smaller in diameter than said second driven pulley.

4. A portable power unit, said power unit comprising:

(a) an internal combustion engine having a drive shaft;

(b) a tank having an interior for holding a supply of a pressurized fluid therein, said tank including pressure switch means, responsive to the pressure of the pressurized fluid within said interior of said tank, for actuating an electrical circuit when the pressure of the pressurized fluid within said interior of said tank is below a certain predetermined value;

(c) an electrical generator means for generating electricity, said electrical generator means having a first driven shaft, said electrical generator means being powered by rotation of said first driven shaft;

(d) a pump means, in communication with the interior of said tank, for pressurizing said fluid into said interior of said tank; said pump means having a second driven shaft, said pump means being powered by rotation of said second driven shaft;

(e) a primary drive means for operably coupling said drive shaft to said first driven shaft, said primary drive means comprising:

i. a first drive pulley fixedly attached to said drive shaft;

ii. a first driven pulley fixedly attached to said first driven shaft; and iii. first drive belt means operably coupling said first drive pulley to said first driven pulley for mutual co-rotation;

(f) a secondary drive means for selectively operably coupling said drive shaft to said second driven shaft, said secondary drive means comprising:

i. a second drive pulley;

ii. a second driven pulley fixedly attached to said second driven shaft;

iii. second drive belt means operably coupling said second drive pulley to said second driven pulley for mutual co-rotation; and iv. electromagnetic clutch means, interposed between said second drive pulley and said drive shaft, for selectively causing said drive shaft to be coupled to said second drive pulley for mutual co-rotation when said electro-magnetic clutch means is energized, said electromagnetic clutch means being operably interconnected with said pressure switch means so that the actuating of said electrical circuit causes said electromagnetic clutch means to be energized wherein said internal combustion engine is in between electrical generator means and pump means; and (g) an electric fan for cooling said pump means, said electric fan being actuated by said pressure switch means together with said electromagnetic clutch means.

5. The portable power unit as recited in claim 4, in which said first drive belt means includes a toothed belt having a plurality of protruding teeth and said first drive pulley and said first driven pulley both have mating recesses engaged by said protruding teeth.

6. The portable power unit as recited in claim 4, in which said first drive pulley is larger in diameter than said first driven pulley and said second drive pulley is smaller in diameter than said second driven pulley.

7. A portable power unit, said power unit comprising:

(a) an internal combustion engine having a drive shaft;

(b) a tank having an interior for holding a supply of a pressurized fluid therein, said tank including pressure switch means, responsive to the pressure of the pressurized fluid within said interior of said tank, for actuating an electrical circuit when the pressure of the pressurized fluid within said interior of said tank is below a certain predetermined value;

(c) an electrical generator means for generating electricity, said electrical generator means having a first driven shaft, said electrical generator means being powered by rotation of said first driven shaft;

(d) a pump means, in communication with the interior of said tank, for pressurizing said fluid into said interior of said tank; said pump means having a second driven shaft, said pump means being powered by rotation of said second driven shaft;

(e) a primary drive means for operably coupling said drive shaft to said first driven shaft, said primary drive means comprising:

i. a first drive pulley fixedly attached to said drive shaft;

ii. a first driven pulley fixedly attached to said first driven shaft, said first drive shaft pulley larger in diameter than said first driven pulley; and iii. first drive belt means operably coupling said first drive pulley to said driven pulley for mutual co-rotation, said first drive belt means including a toothed belt having a plurality of protruding teeth and said first drive pulley and said first driven pulley both having mating recesses engaged by said protruding teeth;

(f) a secondary drive means for selectively operably coupling said drive shaft to said second driven shaft, said secondary drive means comprising:

i. a second drive pulley;

ii. a second driven pulley fixedly attached to said second driven shaft, said second drive pulley being smaller in diameter than said second driven pulley;

iii. second drive belt means operably coupling said second drive pulley to said second driven pulley for mutual co-rotation; and iv. electromagnetic clutch means, interposed between said second drive pulley and said drive shaft, for selectively causing said drive shaft to be coupled to said second drive pulley for mutual co-rotation when said electro-magnetic clutch means is energized, said electromagnetic clutch means being operably interconnected with said pressure switch means so that the actuating of said electrical circuit causes said electromagnetic clutch means to be energized; and (g) an electric fan means for cooling said pump means, said electric fan means being actuated by said pressure means together with said electromagnetic clutch means.

* * * * *

UNITED STATES PATENT AND TRADEMARK OFFICE

CERTIFICATE OF CORRECTION

PATENT NO. : 6,547,527 B2
DATED : April 15, 2003
INVENTOR(S) : Harold E. Gaither It is certified that error appears in the above-identified patent and that said Letters Patent is hereby corrected as shown below:

Column 2,
Line 30, insert -- a -- between “provide” and “compact”

Column 3,
Line 67, replace “shave” with -- shaft --

Column 4,
Line 3, replace “boost” with -- booster --

Column 5,
Line 26, “18” should not be in bold

Column 6,
Line 6, “12-12” should not be in bold
Line 8, “13-13” should not be in bold Columns 7 and 8,
Fig Nos. 60a, 68a, 68b, 72a, 72b, 74a, 74b - all have letter italicized, not bold Column 9,
Line 1, delete “When”

Column 10,
Line 12, replace “boos” with -- boost --

Column 12,
Line 56, delete “shaft”, insert -- being -- between “pulley” and “larger”
Line 59, insert -- first -- between “said” and “driven”

UNITED STATES PATENT AND TRADEMARK OFFICE

CERTIFICATE OF CORRECTION

PATENT NO. : 6,547,527 B2
DATED : April 15, 2003
INVENTOR(S) : Harold E. Gaither It is certified that error appears in the above-identified patent and that said Letters Patent is hereby corrected as shown below:

Column 14,
Line 7, insert -- switch -- between "pressure" and "means"

Signed and Sealed this

Twenty-sixth Day of August, 2003

JAMES E. ROGAN
*Director of the United States Patent and Trademark Office*